US005298104A

United States Patent [19]

Absher

[11] Patent Number: 5,298,104

[45] Date of Patent: Mar. 29, 1994

[54] FLEXIBLE BAG WITH A REMOVABLE COUPON AND A METHOD AND APPARATUS FOR THE MANUFACTURE THEREOF

[76] Inventor: Scott Absher, 320 Gentry, Park Forest, Ill. 60466

[21] Appl. No.: 769,931

[22] Filed: Sep. 30, 1991

[51] Int. Cl.[5] ..... B65H 61/00; B65C 9/00; B26D 1/00; B31B 19/00

[52] U.S. Cl. ..... 156/363; 156/351; 156/355; 156/552; 156/379; 493/11; 493/22; 493/24; 493/29

[58] Field of Search ..... 156/552, 351, 355, 363, 156/367, 368, 354, 353; 493/220, 221, 11, 22, 24, 29, 210

[56] References Cited

U.S. PATENT DOCUMENTS

| | | | |
|---|---|---|---|
| D.229,896 | 1/1974 | Bemel | D9/249 |
| D.237,780 | 11/1975 | Bemel | D9/249 |
| 2,614,349 | 10/1952 | Barnes | 40/2 |
| 3,511,735 | 5/1970 | Lindley | 493/221 X |
| 3,804,323 | 4/1974 | Bemel | 229/53 |
| 4,281,762 | 8/1981 | Hattemer | 206/390 |
| 4,359,358 | 11/1982 | Hattemer | 156/248 |
| 4,479,838 | 10/1984 | Dunsirn | 283/81 |
| 4,537,586 | 8/1985 | Gale et al. | 493/220 |
| 4,545,781 | 10/1985 | Carl et al. | 493/220 |
| 4,726,171 | 2/1988 | Kreager et al. | 53/410 |
| 4,767,654 | 8/1988 | Riggsbee | 493/220 X |
| 4,837,088 | 6/1989 | Freedman | 156/247 X |
| 4,909,636 | 3/1990 | De Matteis et al. | 383/8 |
| 5,009,518 | 4/1991 | Faltynek | 383/106 |
| 5,011,466 | 4/1991 | De Matteis et al. | 493/188 |
| 5,019,436 | 5/1991 | Schramer | 156/247 X |

FOREIGN PATENT DOCUMENTS

| | | | |
|---|---|---|---|
| 2218541 | 11/1989 | United Kingdom | 493/11 |
| 2221422 | 7/1990 | United Kingdom | 493/24 |

OTHER PUBLICATIONS

Lytel, Allan "Photoelectric Register Controls" *Industrial Electronics,* (Jan., 1960) pp. 38≧42.

*Primary Examiner*—David A. Simmons
*Assistant Examiner*—C. Rainwater
*Attorney, Agent, or Firm*—Willian Brinks Hofer Gilson & Lione

[57] ABSTRACT

There is provided a flexible bag with a removable coupon and the method an apparatus for the manufacture thereof. A labeling machine sequentially provides a coupon assembly comprising an adhesive portion and a coupon portion to bag stock which is inputted into the bag making machine. The bag stock is then cut to form individual bags having removable coupons thereon.

22 Claims, 3 Drawing Sheets

FLEXIBLE BAG WITH A REMOVABLE COUPON AND A METHOD AND APPARATUS FOR THE MANUFACTURE THEREOF

BACKGROUND OF THE INVENTION

This invention relates to flexible bags and more particularly to bags having removable coupons affixed thereto and a method and apparatus for the manufacture thereof.

It has long been the desire of manufacturers, suppliers, retailers, and other sellers of products, goods, and services to efficiently reach consumers with promotional advertising in the form of coupons. Sellers often place coupons in newspapers or magazines to attract customers. However, because many persons in a certain market area do not subscribe to newspapers or magazines containing such coupons, the seller is incapable of reaching those persons. Also, newspapers and magazines are often saturated with ads and coupons. Consequently, such ads may fail to get noticed.

Sellers have recognized that consumers must eventually go to the store to purchase goods. As such, it would be advantageous to place coupons on grocery or shopping bags knowing that such coupons would reach the hands of the consumer. However, prior approaches for applying a coupon to a plastic or paper bag have been deficient; for example, the coupons may not have been easily removable, may not have been attractive to the consumer, or may have damaged the structure of the bag when removed. In addition, prior approaches have been deficient or lacking in applying different coupons sequentially to different bags being formed in the same manufacturing line to prevent inundating the marketplace with just a single coupon. For example, if the average consumer, when going grocery shopping, requires two grocery bags, the manufacturer may not wish that the consumer have two of the same coupons. Moreover, the consumer may wish to have two different coupons for promoting two different products.

U.S. Pat. Nos. 3,804,323, Des. 229,896 and Des. 237,780 to Bemel disclose affixing coupons to the bottom of a paper grocery bag which may be torn away from the edges which are affixed to the bag. However, these patents do not disclose how to apply such coupons to the bottom of the paper bags and do not suggest that such coupons may be placed in any other location. U.S. Pat. No. 3,804,323 further discloses a paper bag in which a marginal portion of the mouth of the bag contains coupons connected thereto by a perforation. However, tearing off the coupons in such a manner may damage the bags, limiting their reusability. Larger bags can be reused as garbage bags and smaller bags can be used as lunch bags when such bags are undamaged.

U.S. Pat. No. 4,537,586 to Gale et al. discloses a strip of coupons which are perforated along a margin thereof defining a margin portion and a detachable coupon portion, the margin portion being adhered to the inside of the front panel of a paper grocery bag. The coupon strip-applying apparatus is designed and positioned to apply the coupon strip at the beginning of the bag-making process. The clarity of the information imprinted on the strip is generally not very distinct and thus may not be attractive to the eye of the consumer.

Finally, U.S. Pat. Nos. 4,909,636 and 5,011,466 to DeMatteis et al. discloses a plastic bag tear off coupon wherein the coupon is readily severed at its bottom scoring from the front bag wall. The coupon is imprinted and dispensed as an integral part of the bag manufacture. However, because the coupon is formed integrally with the plastic bag, the clarity of the information imprinted on the coupon is generally not very sharp.

Consumers may tend to be unwilling to go to the trouble of tearing off coupons from bags perhaps because of the unattractiveness of the coupons placed upon bags which the prior art has provided or because of the difficulty in removing the coupon from the perforations which fasten the coupon to the bag. In addition, the plastic material of some bags may be unsuitable for use as a coupon from the consumers' perspective. Accordingly, there is a need for an inexpensive and efficient way to provide bags having high quality coupons applied thereon which are attractive to the consumer and easily removable such that the consumer will wish to make use of the coupon.

Consequently, it is a primary object of the invention to provide an inexpensive and efficient way to apply high quality coupons to bags so that the coupons are attractive to the consumer yet are easily removable and do not stick to the hands, handbag, wallet, or purse of the consumer.

It is a another object of the invention to provide removable coupons which may be applied to both plastic and paper bags.

It is a further object of the invention to provide a bag manufacturer with the capability of applying different coupons sequentially to different bags being formed in the same manufacturing line to avoid inundating the marketplace with just a single coupon.

SUMMARY OF THE INVENTION

According to a first aspect of the invention, there is provided a bag formed of flexible material having a front and rear panel. A coupon assembly is provided on at least one of the panels having an adhesive portion and a removable coupon portion, the adhesive portion being secured to the bag.

According to a second aspect of the invention, there is provided a method of applying a coupon assembly to a bag formed of flexible material. A continuous web of bag stock is fed in a longitudinal direction. A coupon assembly having an adhesive portion and a coupon portion is sequentially provided to the bag stock, the adhesive portion being secured to the bag stock, the coupon portion being removable from the adhesive portion.

According to another aspect of the invention, there is provided a machine for producing flexible bags with removable coupons comprising a bag making machine having an open region exposing a longitudinal web of bag stock being fed to a cutter in the bag making machine, a labeling machine disposed within the open region above the longitudinal web of bag stock having a sensor to sense the formation of the individual bag, and a platen supporting the bag stock which is disposed below the labeling machine to support the bag stock when a coupon assembly is applied from the labeling machine to the bag stock.

DETAILED DESCRIPTION OF THE PREFERRED EMBODIMENTS

Figure 1:
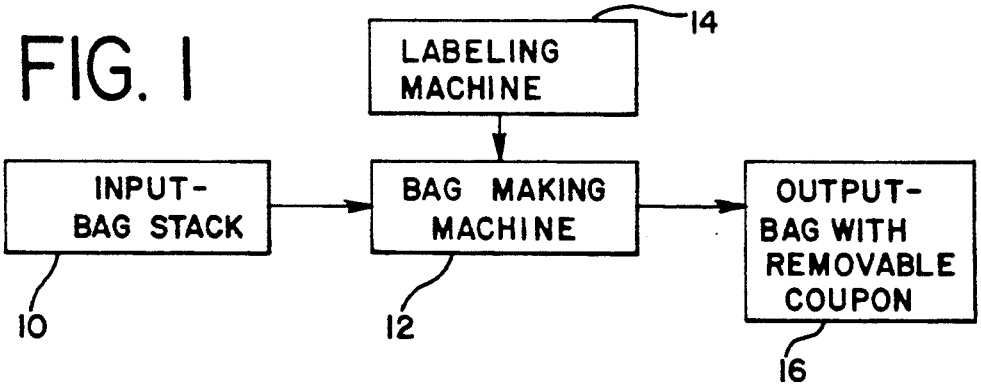
FIG. 1 is a block diagram of the process for making a bag with a label according to an embodiment of the present invention.
Figure 5:
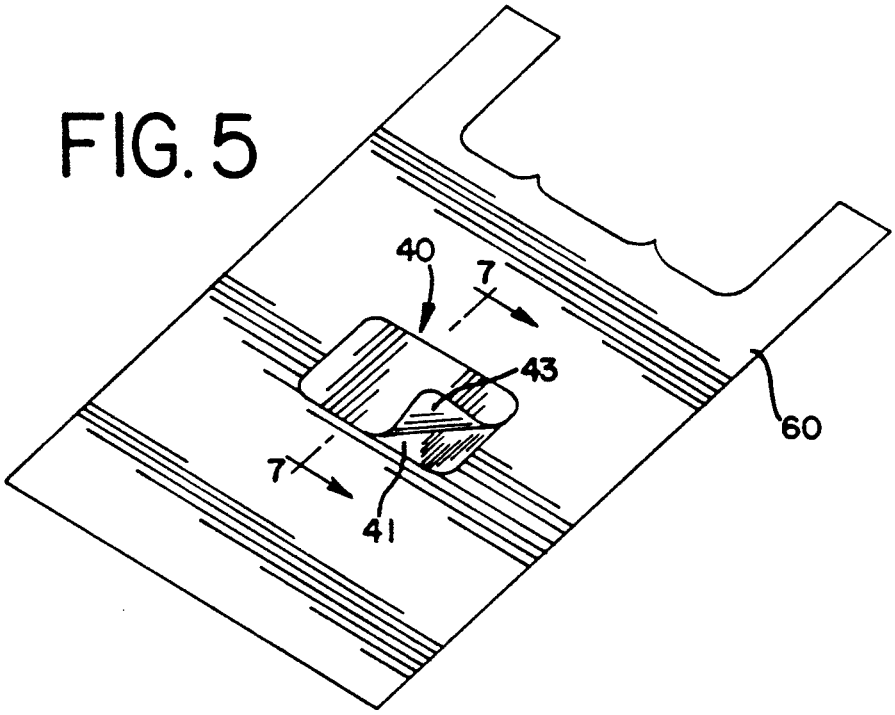
FIG. 5 is a perspective view of a plastic bag with a removable coupon in accordance with an embodiment of the present invention.

Referring to FIGS. 1 and 5, in one embodiment, there is provided a flexible bag with a removable coupon 16 and a method and apparatus for the manufacture thereof. Bag stock 10 is first inputted into a bag making machine 12. Coupon assemblies 40 are applied to the bag stock 10 from a labeling machine 14 during the processing of the bag stock 10 into bags by the bag making machine 12. The bag stock 10 is then cut to form individual bags having a removable label thereon 16.

Figure 2:
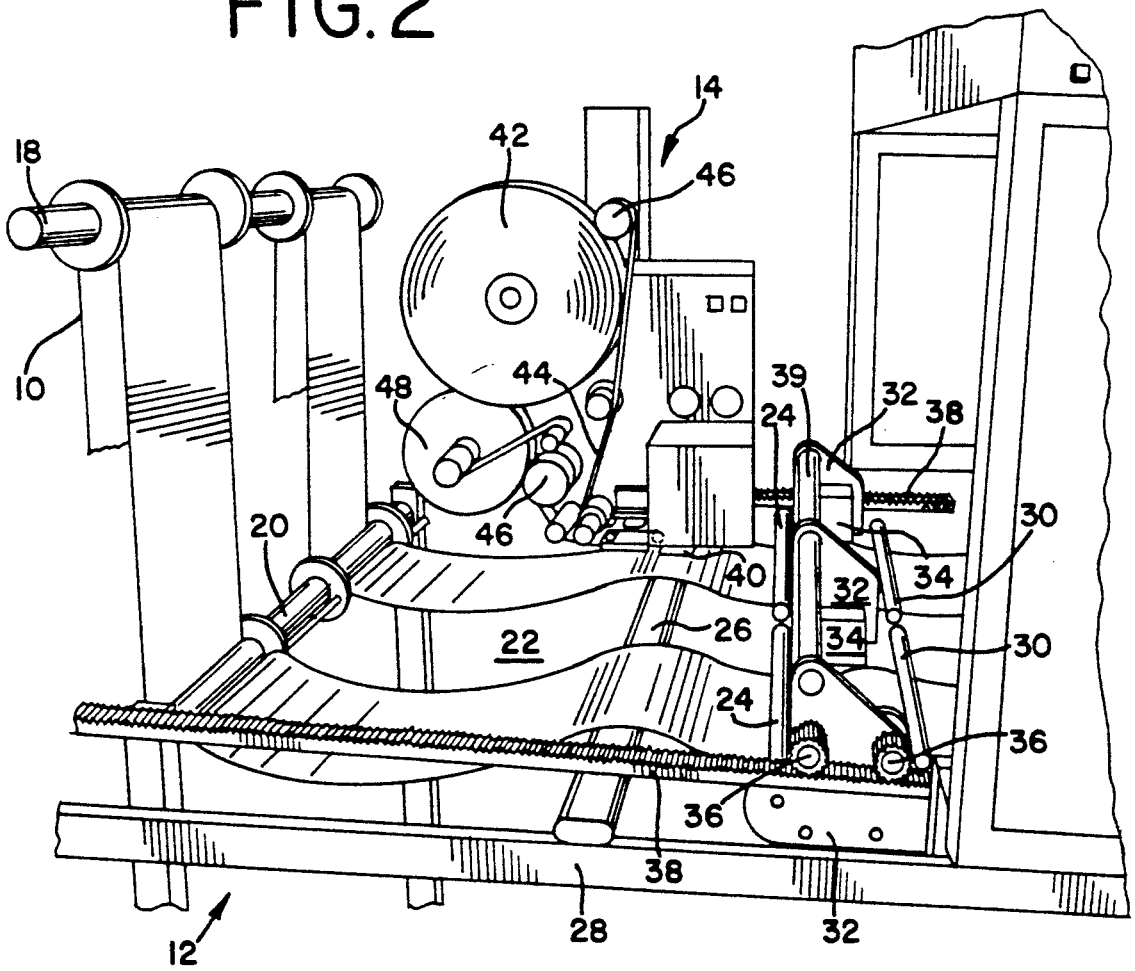
FIG. 2 is a perspective view of the cooperation between the labeling machine and the bag making machine showing only a portion of the bag making machine in accordance with the embodiment of FIG. 1.
Figure 3:
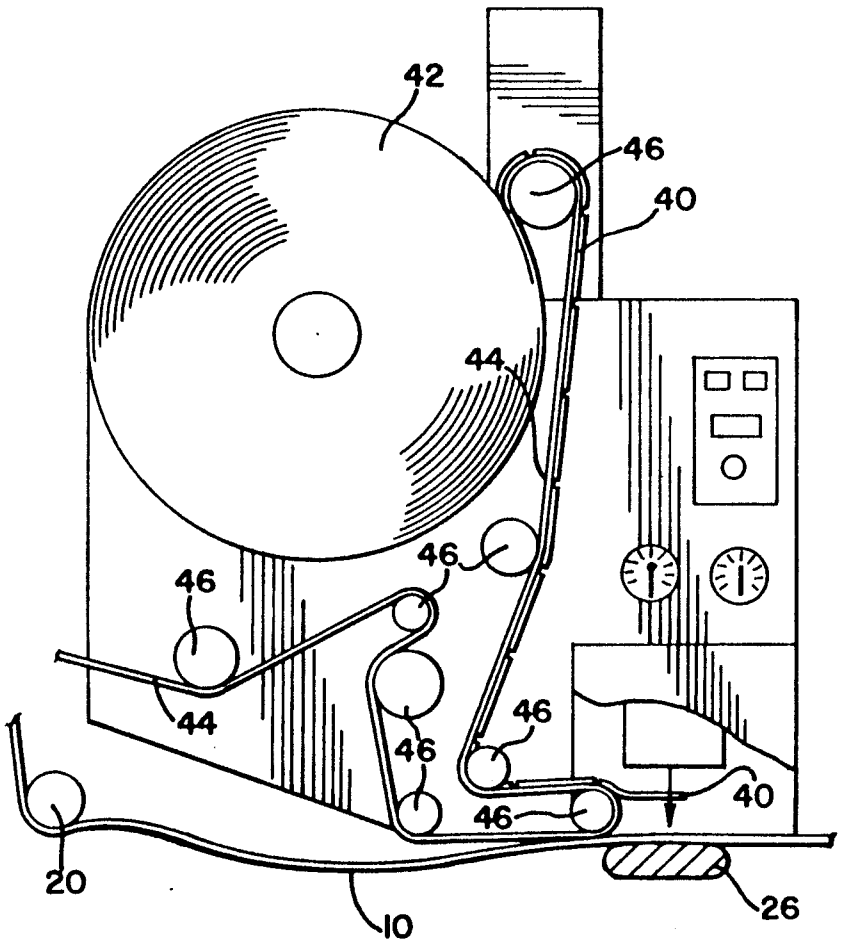
FIG. 3 is an enlarged view of cooperation between the labeling machine and the bag making machine of FIG. 2, the labeling partially cut away to show the application of a coupon assembly to the bag stock.

Referring to FIGS. 2 and 3, there is shown the cooperation between the bag making machine 12 and the labeling machine 14. The labeling machine 14 is preferably a Label-Aire, Inc. Model 2111 labeling machine. The labeling machine 14 is inserted or positioned into an open region 22, such as between rollers 20 and 24 of the bag making machine 12. The bag making machine 12 may be, for example, the Nippon Flute Co. Ltd. NF-80-NMC-FX bag making machine. The labeling machine 14 is required for each line of bag stock 10 being fed to the bag making machine 12.

Figure 4:
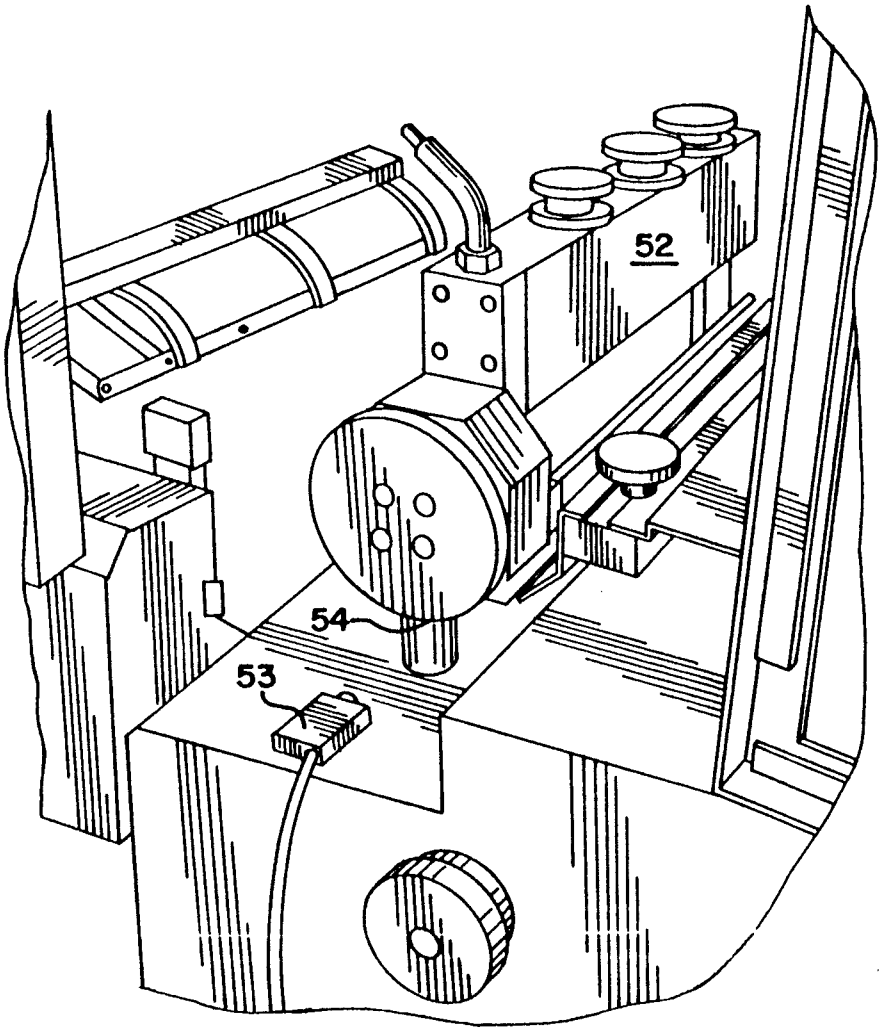
FIG. 4 is a perspective view of the sensor controlling the labeling machine, shown in FIGS. 2 and 3, which triggers from the cutter mechanism on the bag making machine.

It is preferable that the bag making machine 12 have a sufficient open region 22 or is readily modified to provide a sufficient open region 22 to insert or position the labeling machine 14 directly above the bag stock 10 prior to the bag stock being cut to form the individual bags. With the Nippon Flute Co. Ltd. NF-80-NMC-FX bag making machine, this can be done with little or no modification of the bag making machine. Although the Nippon Flute Co. Ltd. NF-80-NMC-FX bag making machine, which manufactures plastic bags, is illustrated in FIGS. 2 through 4, other bag making machines may be utilized. Thus, the labeling machine may be used with either plastic and paper bag making machines. In a preferred embodiment, the width of the open region 22 should be at least twenty-four inches. In addition, if the bag making machine 12 has, or can be readily modified to have, a sufficient open region 22, more than one labeling machine 14 may be utilized for each line of bag stock 10. Thus, more than one coupon assembly 40 may be applied to each single bag being produced.

The continuous web of bag stock 10 is fed in a longitudinal direction via conventionally used rollers 18 and 20 to the open region 22. The bag stock 10 may be paper bag stock or a plastic bag stock formed, for example, of polyethylene. This bag stock 10, generally has preprinted matter, such as the name of the retailer, which will eventually appear directly on the face of the bag. The bag stock 10 is then fed above platen 26 which may be properly secured to member 28 located at each end of the bag making machine 12. The bag stock 10 is then fed under conventionally used rollers 24 and 30 which are secured to mounting plates 32. The mounting plates 32 at each end of the bag making machine 12 carry pinions 36 which ride on rack 38. The mounting plates 32 support a shaft 39 which further supports conventionally used photoeyes 34. The photoeyes 34 may be moved along the longitudinal axis by the rack 38 and pinion 36 to trigger the cutter mechanism 52 of the bag making machine, illustrated in FIG. 4. The photoeyes 34 are adjusted to be in the proper position to read the preprinted material on the bag stock 10, signaling the bag making machine to momentarily halt the feeding of bag stock and cut the bag stock 10 at the appropriate time to form an individual bag.

A reel 42 on the labeling machine 14 provides a release liner 44 containing the coupon assembly 40 thereon. The release liner 44 may be a forty pound supercalendered densified kraft paper which has been silicone coated on one side to provide a controlled release, such as the Technicote forty pound SCK liner. The release liner 44 should have a high internal strength to withstand all conventional processing operations. The release liner 44 is wrapped around conventionally used backing guides 46 to provide the coupon assembly 40 to the bag stock 10. In a preferred embodiment, after the coupon assembly 40 has been "peeled" from the liner 44, the labeling machine 14 holds the coupon assembly 40 approximately ½ inch above the surface of the advancing bag stock 10, e.g., by drawing a vacuum. Then, the labeling machine 4 "blows" the coupon assembly 40 across the ½ inch span onto the bag stock 10. Once the coupon assembly 40 has been provided to the bag stock 10, the release liner 44 is then fed to a second reel 48. The platen 26 is positioned directly under the region where the coupon assembly 40 is blown onto the bag stock 10, as best illustrated in FIG. 3. The platen 26 may be made of cast aluminum or any other rigid material such as steel or even wood or plastic, and is used to provide a flat surface to facilitate application of the coupon assembly 40 to the bag stock 10.

Referring to FIGS. 3 and 4, a sensor 53 of the labeling machine 14 triggers the application of the coupon assembly 40 to the bag stock 10. The sensor used, for example, may be a product scanner part number 7460830 manufactured by Label-Aire, Inc. The sensor 53 is preferably activated when the bag stock 10 is in a stationary position, for example, when the bag stock is being cut to form the individual bags. Thus, the sensor 53 may be placed such that it is activated when the cutter mechanism 52 of the bag making machine 12 is in its lower or cutting position. The sensor 53 may trigger off of the lower edge of the circular member 54 which is connected to the cutter mechanism 52, signaling that the bag stock is in a stationary position due to the fact that the bag stock at that moment in time is being cut. It should be noted that the actual blade for cutting the bag stock 10, which is directly attached to the cutter mechanism 22, is located within the machine illustrated in FIG. 4 and is thus not shown. Alternatively, the sensor 53 may be placed next to photoeyes 34 shown in FIG. 2, which as previously discussed, signal the bag making machine 12 to cut the bag stock and thus stop the feeding of the bag stock temporarily. Consequently, the coupon assembly 40 is blown onto the bag stock 10 when the bag stock is in a stationary position.

Figure 6:
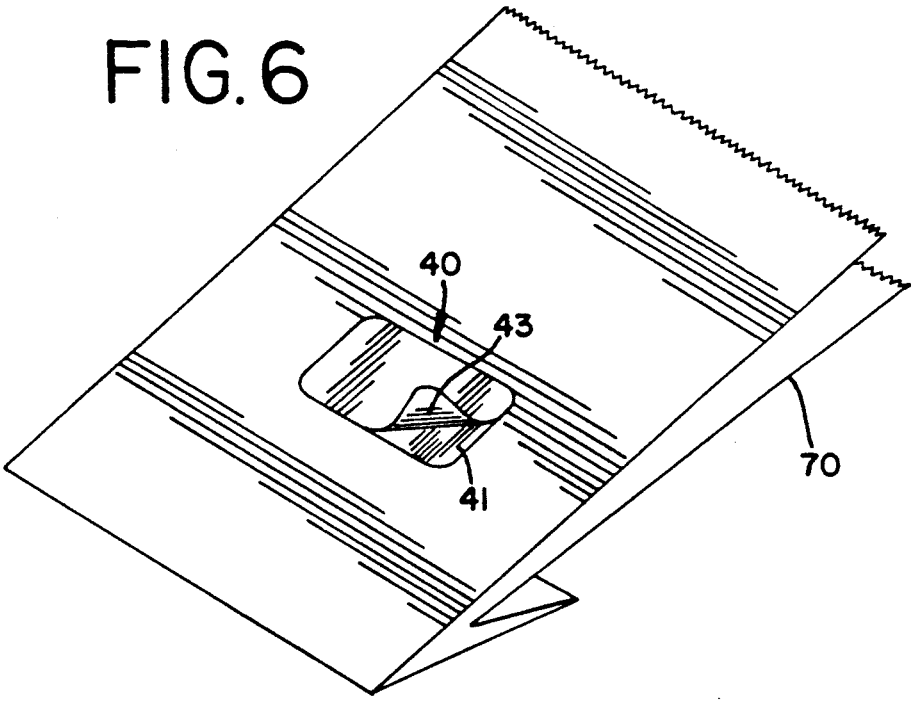
FIG. 6 is a perspective view of a paper bag with a removable coupon in accordance with another embodiment of the present invention.

FIGS. 5 and 6 illustrate a plastic bag 60 and a paper bag 70, respectively, comprising embodiments of the present invention and produced according to methods described above. Bags 60, 70 have coupon assemblies 40 applied thereon.

Figure 7:
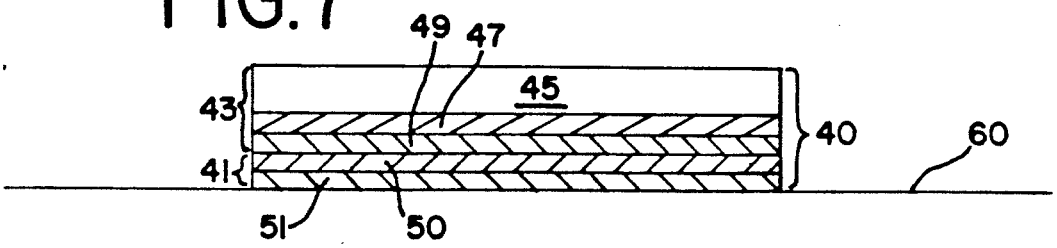
FIG. 7 is a cross sectional view of the coupon assembly shown in FIG. 5 taken along the lines 7-7.

Referring also to FIG. 7, the coupon assembly 40 comprises a coupon portion 43 and an adhesive portion 41. The coupon assembly may be, for example, Technicote's Magic Film construction coated with a one-half mil NTC clear polyester TP110 adhesive. It is preferable that the adhesive portion 41 and the coupon portion 43 be coextensive in size. It is also preferable that the coupon portion 43 be easily removable from the adhesive portion 41.

The coupon portion 43, which is removable, comprises three layers. The first layer is a semigloss paper layer 45. The paper layer 45 may contain previously printed advertising material or indicia on both sides thereof. The second layer is a patterned adhesive layer 47. The patterned adhesive layer 47 secures a coated one-half mil clear polyester layer 49, the third layer, to the semigloss paper layer 45. This, coupon portion 43 may represent, for example, an ordinary store coupon, a label, or a sticker, which may be placed upon the bag 60, 70.

The adhesive portion 41 of the coupon assembly 40 comprises a one-half mil clear polyester layer 50 and an adhesive layer 51. The adhesive layer 51 is preferably made of a general purpose permanent acrylic emulsion having a good initial tack and high ultimate adhesion. The polyester layer 49 of the coupon portion 43 and the polyester layer 50 of the adhesive portion 41 are attached when they are on release liner 44, shown in FIGS. 2 and 3, forming the coupon assembly 40, with the adhesive layer 51 of the adhesive portion 41 in contact with the liner 44 to secure the entire coupon assembly 40 thereupon. The adhesive layer 51 of the adhesive portion 41 contacts the bag stock 10 when the coupon assembly 40 is thrown onto the bag stock 10, as best illustrated in FIGS. 3 and 7. When the coupon portion 43 is removed by the consumer from the bag 60, 70, the polyester layers 49 and 50 separate. The adhesive portion 41, consisting of both the polyester layer 50 and the adhesive layer 51, remains on the bag 60, 70. The coupon portion 43 does not stick to the hands, handbag, wallet, or purse of the consumer because the back of the coupon portion 43 is the polyester layer 49, a non-sticky surface.

For production purposes, it is best to have a semigloss paper layer 45 having a weight that is sufficiently high enough that the adhesive portion 41 on the coupon assembly 40 is properly applied to the bag stock 10 yet is not so high that it impedes the feeding of the bag stock. When plastic bags are being formed, fifty to sixty pound semigloss paper is preferred.

Due to the capability of the labeling machine 14, different coupons may be sequentially applied to different bags being formed in the same manufacturing line to prevent inundating the marketplace with just a single coupon. For example, the coupon portions 43 located on the release liner 44 may alternate in a pattern such that the same coupon portion is applied to every second, third, or fourth bag being produced. In addition, the coupon portion 43 may contain a perforation in the center thereof, thus forming two coupons on the bag during a single application of the coupon assembly 40.

The coupon assembly 40 is preferably applied at a stage in the bag making process after which the bag stock 10 is no longer wound through turns provided by bag making machine rollers, such as the conventionally used dancing rollers, not shown, in the bag making machine 12 which feed the bag stock 10 to the cutter mechanism 52. This prevents the undesired removal of the coupon 43 from the coupon assembly 40 during the manufacture of the bags which might otherwise occur if the bag stock 10 was then wound around rollers or otherwise processed after the coupon assembly 40 had been applied.

Manufacturers of labels are capable of placing up to eight different colors on the coupons in one embodiment. In addition, because the images are produced on the coupon portion 43, and specifically on the semigloss paper layer 45, rather than dyed onto the bag material itself, as was done in some of the prior art, sharper images may be obtained. Thus, the many attractive colors and the sharper images produced on the coupon portion 43 may be more attractive to the consumer such that the consumer may wish to make use of the coupon.

As discussed earlier, the bag stock 10 generally has preprinted matter, such as the name of the retailer, which will eventually appear directly on the face of the bag. Because the coupon assembly 40 is applied to the bag stock 10 in a later part of the process, that is, after the bag stock 10 itself contains the preprinted matter, a retailer need not change its inventory of bag stock 10 when desiring to place coupons on grocery bags. In general, all that is required is take the bag stock 10 already produced and apply the appropriate number of coupon assemblies 40 desired upon the bag stock 10. Thus, in preparing for a certain promotion, the retailer may generally only anticipate the number of coupons that will be needed. There is generally no need to specifically plan for the amount of bag stock that will be required for that promotional scheme because the bag stock used may just come from the retailer's general inventory and need contain preprinted material directed to any specific promotional scheme.

It is to be understood that the forms of the invention described herewith are to be taken as preferred examples and that various changes in the shape, size and arrangement of parts may be resorted to, without departing from the spirit of the invention or scope of the claims.

I claim:

1. A method of applying a coupon assembly to a bag formed of flexible material comprising:

feeding a continuous web of bag stock in a longitudinal direction;

sensing preprinted material on said bag stock for cutting said bag stock to form an individual shopping bag and sequentially providing a coupon assembly to said bag stock, said coupon assembly having an adhesive portion and a coupon portion, said adhesive portion being secured to said bag stock and said coupon portion being removable from said adhesive portion; and cutting said bag stock as a step in forming said shopping bag said coupon assembly being on an exterior surface of said shopping bag to be formed wherein said coupon assembly is provided to said bag stock when cutting said bag stock.

2. The method of claim 1 wherein said coupon assembly is provided to said bag stock when said bag stock is stationary.

3. The method of claim 2 in which the providing step further comprises feeding said coupon assembly to said bag stock from a reel on a labeling machine, said real having a plurality of said coupon assemblies located on said reel.

4. The method of claim 3 further comprising the step of providing a plurality of said coupon portions, each having a semigloss paper layer, a polyester layer, and a patterned adhesive layer disposed between said semigloss paper layer and said polyester layer, to said reel.

5. The method of claim 4 further comprising the step of providing a plurality of said adhesive portions, each having a polyester layer and a permanent acrylic emulsion on one surface, to said reel.

6. The method of claim 5 further comprising the step of providing a plurality said semigloss paper layers on said coupon assemblies having sequentially imprinted alternating information to said reel.

7. The method of claim 5 further comprising the step of providing a plurality of said semigloss paper layers, each having a perforation thereon for defining two coupon regions, to said reel.

8. The method of claim 1 wherein said bag stock is plastic bag stock.

9. The method of claim 1 wherein said bag stock is paper bag stock.

10. A method of applying a coupon assembly to a bag formed of flexible material comprising:

intermittently feeding a continuous web of bag stock in a longitudinal direction, said bag stock being stationary when an end of an individual bag to be formed is cut;

sensing preprinted material on said bag stock for cutting said bag stock to form an individual shopping bag and for sequentially providing a coupon assembly to said bag stock, said coupon assembly having an adhesive portion and a coupon portion, said adhesive portion' being secured to said bag stock, and said coupon portion being removable from said adhesive portion; and cutting said bag stock as a step in forming said shopping bag said coupon assembly being placed on an exterior surface of said shopping bag to be formed wherein said coupon assembly is provided to said bag stock when cutting said bag stock.

11. The method of claim 10 wherein said step of sensing is further characterized as sensing when said bag stock is stationary and providing said coupon assembly to said bag stock when said bag stock is stationary.

12. The method of claim 11 in which the providing step further comprises feeding said coupon assembly to said bag stock from a reel on a labeling machine, said real having a plurality of said coupon assemblies located on said reel.

13. The method of claim 12 further comprising the step of providing a plurality of said coupon portions, each having a semigloss paper layer, a polyester layer, and a patterned adhesive layer disposed between said semigloss paper layer and said polyester layer, to said reel.

14. The method of claim 13 further comprising the step of providing a plurality of said adhesive portions, each having a polyester layer and a permanent acrylic emulsion on one surface, to said reel.

15. The method of claim 14 further comprising the step of providing a plurality of said semigloss paper layers on said coupon assemblies having sequentially imprinted alternating information to said reel.

16. The method of claim 14 further comprising the step of providing a plurality of said semigloss paper layers, each having a perforation thereon for defining two coupon regions, to said reel.

17. The method of claim 10 wherein said bag stock is plastic bag stock.

18. The method of claim 10 wherein said bag stock is paper bag stock.

19. The method of claim 1 wherein said coupon assembly is affixed to said bag stock prior to when said bag stock is cut to form an individual shopping bag.

20. The method of claim 19 wherein said coupon assembly is affixed to said bag stock which forms a front panel of said shopping bag.

21. The method of claim 1 in which the coupon assembly is provided to said bag stock simultaneously with said bag stock being cut.

22. The method of claim 10 in which the coupon assembly is provided to said bag stock simultaneously with said bag stock being cut.

* * * * *